United States Patent [19]

Vassiliadis

[11] Patent Number: 4,704,832

[45] Date of Patent: Nov. 10, 1987

[54] BUILDING SYSTEM

[76] Inventor: Theodor Vassiliadis, 1736 Amphion Street, Victoria, Canada, V8R 4Z7

[21] Appl. No.: 865,355

[22] Filed: May 20, 1986

[51] Int. Cl.[4] ..... E04B 1/02

[52] U.S. Cl. ..... 52/279; 52/284; 52/570; 52/574

[58] Field of Search ..... 52/569–571, 52/606, 611, 437, 439, 574, 561, 279, 262, 264, 300, 92, 293, 712, 438, 284, 286, 258, 259

[56] References Cited

U.S. PATENT DOCUMENTS

| | | | |
|---|---|---|---|
| 793,645 | 7/1905 | Ewing | 52/279 |
| 941,617 | 11/1909 | Chapman | 52/712 |
| 1,124,404 | 1/1915 | Featherstone | 52/259 |
| 1,388,181 | 8/1921 | Guimonneau | 52/571 |
| 1,514,714 | 11/1924 | Needham et al. | 52/293 |
| 1,785,067 | 12/1930 | Bemis | 52/300 |
| 2,241,169 | 5/1941 | Yokes | 52/606 |
| 3,939,618 | 2/1976 | Murphy | 52/293 |
| 4,123,881 | 11/1978 | Muse | 52/438 |
| 4,176,504 | 12/1979 | Huggins | 52/293 |
| 4,237,670 | 12/1980 | De Waele | 52/436 |

FOREIGN PATENT DOCUMENTS

| | | | |
|---|---|---|---|
| 188990 | 11/1922 | United Kingdom | 52/574 |
| 241445 | 10/1926 | United Kingdom | 52/284 |

*Primary Examiner*—James L. Ridgill, Jr.

*Attorney, Agent, or Firm*—Christie, Parker & Hale

[57] ABSTRACT

A building block able to interlock with a similar building block. The block has a wall portion having a flat outer surface and an inner surface. At least one hollow spaced projection extends from the inner surface. Each projection comprises a narrow portion adjacent the inner surface and a wide portion extending from the narrow portion. The width of the wide portion is substantially equal to the distance between the neighboring narrow portions and the width of the narrow portion is substantially equal to the distance between the neighboring wider portions. The wall portion extends beyond the projections at at least one end of the block by an amount substantially equal to half the width of the block by an amount substantially equal to half the width of a wider portion.

12 Claims, 9 Drawing Figures

86
96
94
88
90
92
92
88
76
76
72
70
74
70
72
76
76
74
76
84
82
78
80
80
84
102
102
98
100

BUILDING SYSTEM

FIELD OF THE INVENTION

This invention relates to a building block able to interlock with a similar building block.

DESCRIPTION OF THE PRIOR ART

Use of interlocking building blocks has long been seen as desirable in the construction industry. Such blocks have the particular advantage of permitting dry stacking. They can be stacked very rapidly, compared with the more traditional use of building blocks and bricks which must be laid with the use of mortar. Typically interlocking building blocks are stacked dry and mortar added to the hollow cores of the blocks to provide the necessary stability from bonding together of the blocks.

However prior art suggestions, although numerous, have not met universal acceptance. The disadvantages in such schemes include the relative complexity of the interlocking mechanism and difficulties in arriving at a system sufficiently simple to be consistently reproducible and economic to produce.

Examples of prior art known to applicant include the following U.S. Pat Nos. 4,237,670 to De Waele; 4,123,881 to Muse; 793,645 to Ewing; 1,514,714 to Needham; 2,138,182 to Lipthrott; 2,241,169 to Yokes; 3,939,618 to Murphy; and 4,176,504 to Huggins. The above patents exemplify the prior art disadvantages of relative complexity. Generally speaking these prior patents do not show linking together of the blocks, with the inherent stability that such linking imparts to the finished structure. The reference to Ewing is pertinent as is the reference to Needham. Ewing however does not show a positive link between two blocks to make up a single row and Needham also fails to show a positive linkage between blocks.

SUMMARY OF THE INVENTION

The present invention seeks to produce a building block able to interlock with a similar building block to produce a wall of considerable stability. Furthermore other components are provided, according to the present invention, that greatly simplify the construction of a building using the building block of the present invention.

Accordingly the present invention, in a first aspect, is a building block able to interlock with a similar building block and comprising a wall portion having a flat outer surface and an inner surface; a plurality of spaced projections extending from the inner surface; each projection comprising a narrow portion adjacent the inner surface and a wide portion extending from the narrow portion, the width of the wider portion being substantially equal to the distance between the neighbouring narrow portions and the width of the narrow portion being substantially equal to the distance between the neighbouring wider portions; the wall portion extending beyond the projections at at least one end of the block by an amount substantially equal to half the width of a wider portion.

DRAWINGS

Aspects of the invention are illustrated, merely by way of example, in the accompanying drawings in which:

FIG. 1*a* is a building block according to the present invention;

FIG. 1*b* is a half-length building block according to the present invention;

FIG. 2*a* is a half-depth building block;

FIG. 2*b* is a half-depth, half-length block;

DESCRIPTION OF THE PREFERRED EMBODIMENTS

Figure 1A:
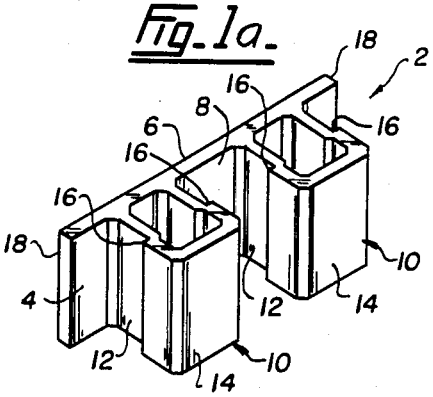
Figure 2A:
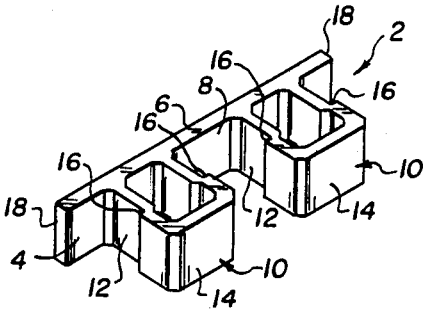
Figure 1B:
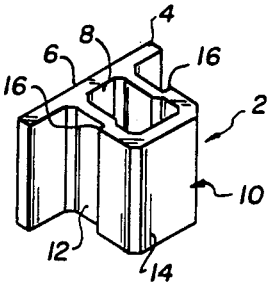
Figure 2B:
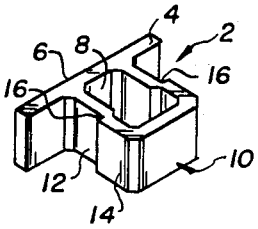

FIGS. 1*a* through 2*b* show building blocks according to the present invention. They differ in that the blocks of FIGS. 2*a* and 2*b* are half the height of the blocks of FIGS. 1*a* and 1*b*.

Thus FIGS. 1*a* through 2*b* show a building block 2 able to interlock with a similar block and comprising a wall portion 4 having a flat outer surface 6 and an inner surface 8. There are projections 10 extending from the inner surface, the projections are spaced apart in the FIGS. 1*a* and 2*a* embodiments. Each projection comprises a narrow portion 12 adjacent the inner surface 8 and a wide portion 14 extending from the narrow portion 12. The two portions meet at shoulders 16. As most clearly apparent from FIGS. 6 and 7 the width of the wide portions 14 is substantially equal to the distance between neighbouring narrow portions 12 and the width of the narrow portions 12 is substantially equal to the distance between neighbouring wider portions 14. The shoulders 16 between the portions 12 and 14 on each block 2 abut when a wall is constructed.

Figure 4:
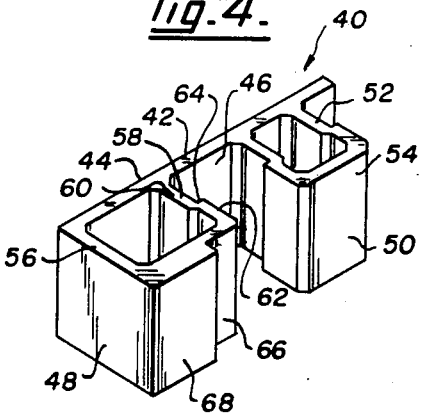
FIG. 4 illustrates an end unit useful in the present invention.

The wall portions 4 extend beyond the projection at 18 at at least one end of the block by an amount substantially equal to half the width of a wider portion 14. This is illustrated particularly in FIGS. 1*a* through 2*b* where the wall portion 4 extends at each end of the block 2. FIG. 4 illustrates an end unit where the wall portion 18 extends only at one end of the block.

As indicated in all the drawings, the projections 10 are hollow.

Figure 3:
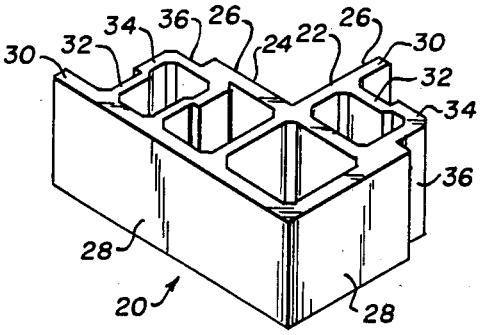
FIG. 3 illustrates a corner unit useful in the present invention.

FIG. 3 illustrates a corner unit 20 that is of generally L-shape. The limbs 22 and 24 of the L are of the same length. Each limb terminates in a shape corresponding to the shape of the end of the building block shown in, for example, FIGS. 1*a* and 1*b*. That is the building blocks of 1*a* through 2*b* can be placed to abut the end of the corner unit shown in FIG. 3.

In more detail the generally L-shaped unit shown in FIG. 3 has flat inner and outer walls 26 and 28. Inner walls 26 are the same length. Outer walls 28 are of different lengths—see FIG. 3. The end of each limb of each L terminates in a projecting portion. One projecting portion 30 is on the outer wall 28 of limb 24 and the other projecting portion 30 is on the inner wall 26 of limb 22. A web 32 extends from adjacent each projecting portion 30. The web 32 extends away from the wall with the projecting portion 30 with an extension 34 to the web remote from the projection 30, extending in the same general direction as the web 32 perpendicular to wall 28. There is a recess 36 on the surface remote from the projecting portion 30 whereby the ends of each corner unit may engage with the building block as shown in FIGS. 1*a* through 2*b*, that is with projection 18 of the block engaging recess 36 of the corner unit. The arrangement is most clearly shown in FIG. 6.

FIG. 4 illustrates an end unit 40 useful with the building blocks of FIGS. 1*a* through 2*b*. Its use is shown particularly in FIG. 7. The end unit 40 comprises a wall portion 42 having a flat outer surface 44 and a flat inner surface 46. There is a flat end surface 48. A first projection extends 50 from the inner surface 46 and a projection comprising a narrow portion 52 adjacent the inner surface and a wider portion 54 extending from the narrow portion 52. That is the arrangement is precisely as shown in FIG. 1*a* through 2*b*.

Figure 7:
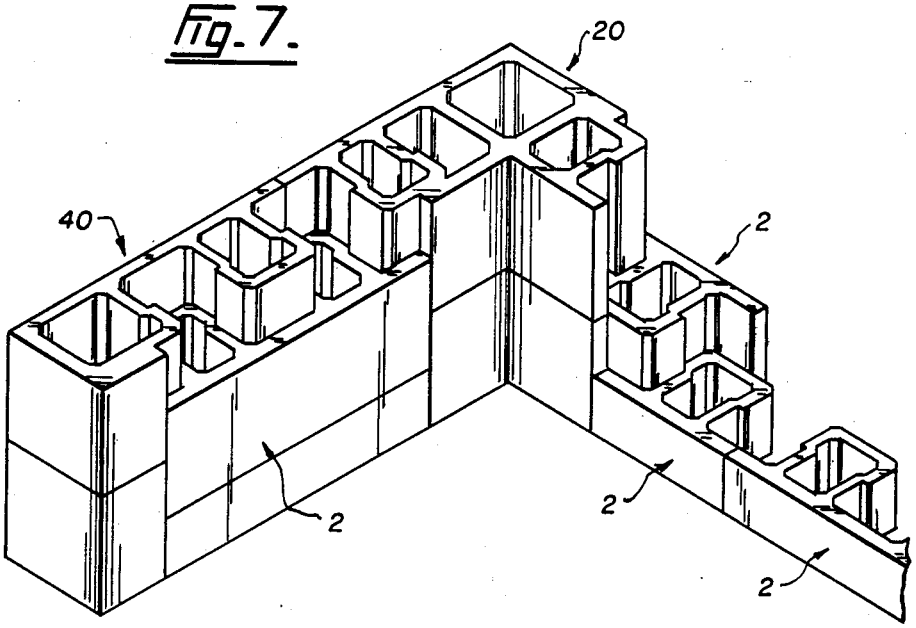
FIG. 7 illustrates both the construction of a corner using a block according to the present invention and an end unit.

In FIG. 4 there is a second projection 56 extending from the inner wall 46 and including as one wall the end wall 48 of the corner unit 40. There is a wall 58 remote from the end wall 48 comprising a first web 60 extending outwardly from the wall surface 46 and a second web 62 attached to the first web 60 and attached to web 60 at shoulder 64. This wall 58 acts to define a recess 66 with an inner wall 68 of the projection 56. Recess 66 receives a corresponding projection of another building block as shown in FIG. 7.

Figure 5:
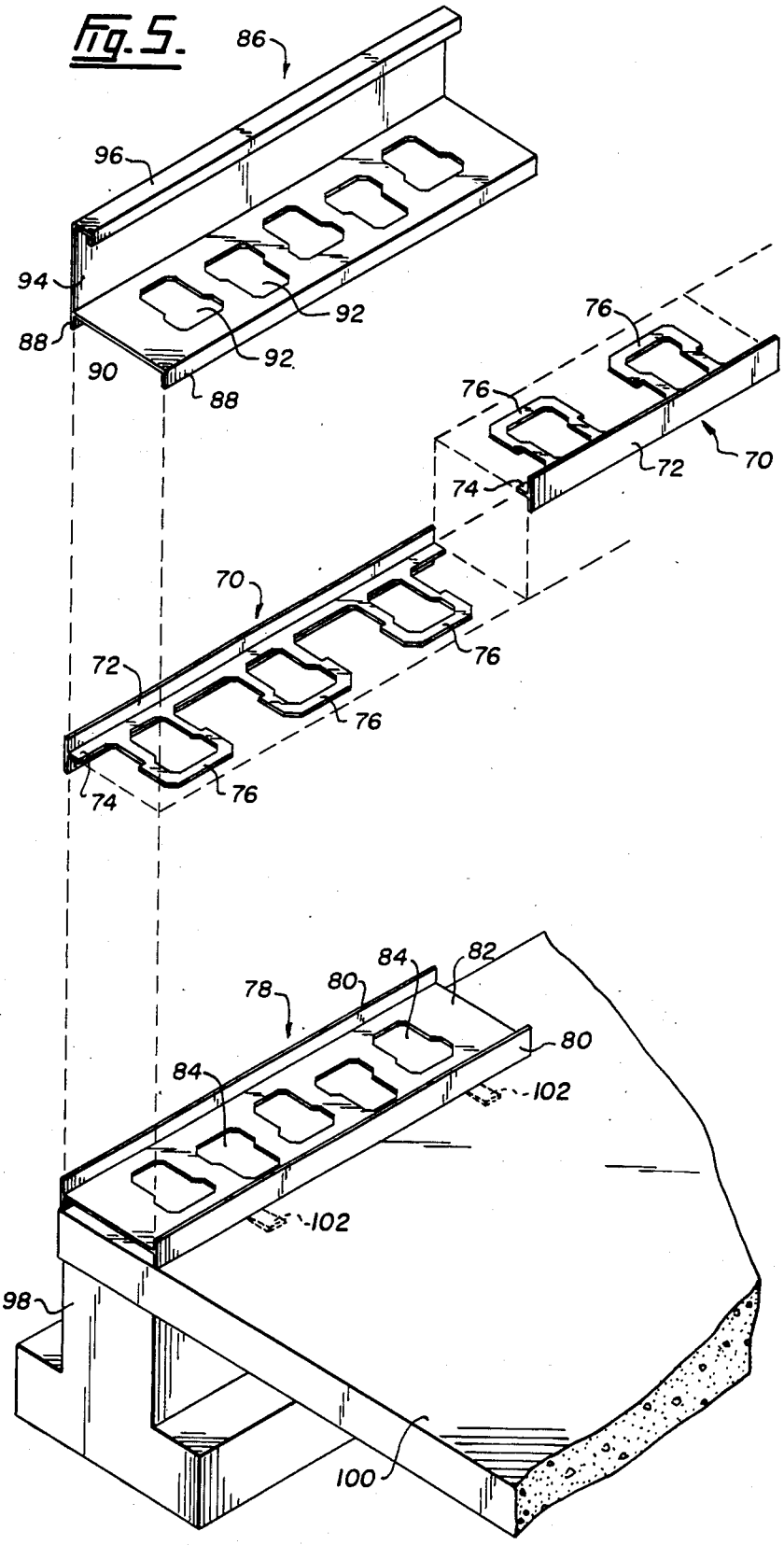
FIG. 5 illustrates the use of various ancillary components in building a wall using the blocks of the present invention.

In building a wall using the blocks of the present invention various ancillary units are required. These are shown particularly in FIG. 5 and include a key 70 to facilitate alignment of the blocks. The key 70 comprises a flat bar 72 with a second bar 74 at right angles to the flat bar 72. A plurality of projections 76 extend from the second bar 74 and match in their peripheral shape the shape of a projection 10 on a block.

A starting channel 78 is positioned at the bottom of a wall to receive a first course of blocks. It comprises opposed parallel bars 80 joined by an intersecting flat web 82 so that the overall shape is of a I. There are openings 84 formed in the central web 82 shaped to match the interior of the hollow projections 10 on a block.

There is also a capping channel 86 comprising opposed parallel surfaces 88. There is a web 90 extending between the surfaces 88 and openings in the web 92 correspond to the projections 10 in the building block. Side wall 94 extends upwardly at an outer surface to receive the roof of the last course of blocks.

In the illustrated embodiment the outer wall 94 ends in a channel section 96 at its upper edge.

To construct a wall according to the present invention the following procedure is followed.

Figure 6:
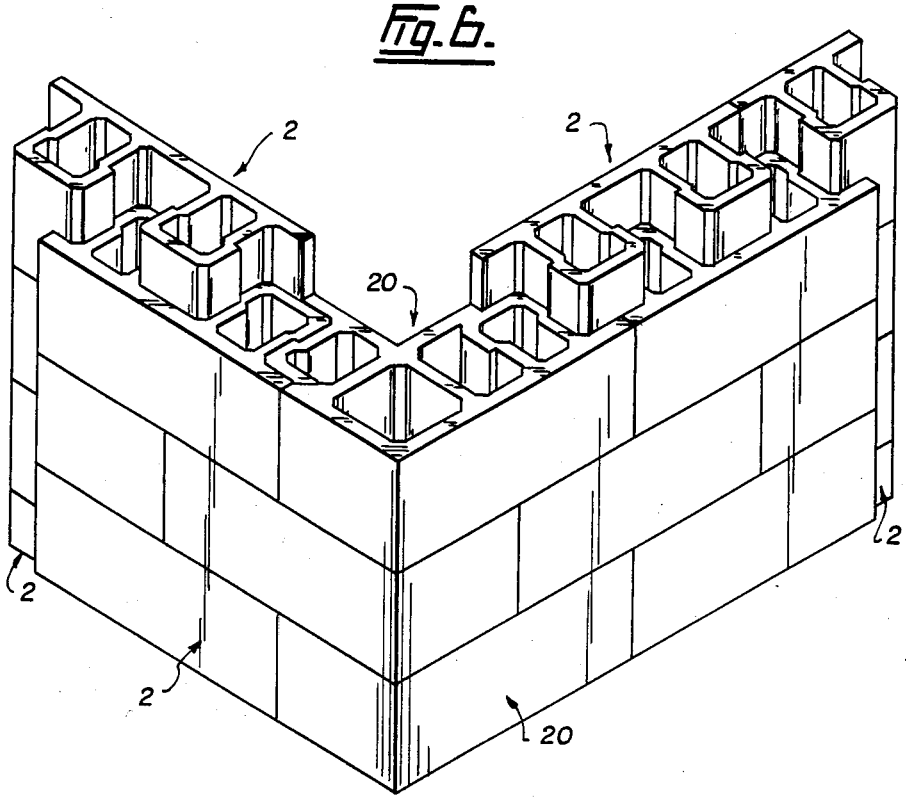
FIG. 6 illustrates a portion of a building using the blocks according to the present invention, at a corner of the building.

First the site is prepared. Such preparation will follow general civil engineering principles depending on the load. For a typical residental application the proposed premises are levelled for a foundation 98 and a floor 100 is formed, all in accordance with conventional practice. A starting channel 78 is laid, aligned and shim-levelled by the use of shims 102. The first course of blocks are then laid in the manner shown in FIG. 6. This first row will comprise an inside row of half-height blocks as shown in FIG. 2*b*. An outside row of full-sized blocks as shown in FIG. 1*a* is then laid. The arrangement is shown at the right-hand side of FIG. 7. All successive rows, inside and outside, consist of full size blocks as in FIG. 1*a*, and as shown in FIGS. 6 and 7. Blocks are laid dry by simply sliding one block down the space provided between projections 10 so that the interlocking projections form a solid wall. The arrangement is shown in FIGS. 6 and 7. As shown particularly in FIG. 6 corner blocks are turned over at each row to keep a running bond on the outside, again as most clearly shown in FIG. 6. On the inside the use of half-length blocks as shown in FIGS. 1*b* and 2*b* creates the running bond, the FIG. 1*b* block bind used at the lowest level. Running bond is the arrangement whereby the seams of adjacent rows do not align with each other.

At about every meter in height keys 70 are used inside and out to re-align the wall and at every storey alignment can be corrected.

Openings for windows and doors are formed by using the end blocks shown in FIG. 6. The arrangement is shown at the left of FIG. 7 where the flat end surface forms the inner surface of the wall or in window.

The top of the opening for the window or door is spanned by light metal channel or is temporarily framed using wood. The wood is removed when the blocks over the opening can be filled with concrete.

At the end of each storey a capping channel is positioned. The floor-roof unit of the next storey is then inserted. Conventional wood flooring may be used but cast-in-place floors and flat roofs can be constructed using the channel shown in FIG. 4 at the top. Corrugated iron, temporarily braced along the centre of the span can be used to create an arched form. Suitable reinforcing steel is placed in concrete poured and finished. After the concrete is set the temporary bracing is removed.

The next storey started as the first with a starting channel aligned and shim-levelled. Successive storeys are then constructed using the same method.

As indicated at certain levels the voids in the wall are filled with concrete, thus providing the necessary stability and permanence of the wall.

Thus the invention provides a building block as easy to use as any prior art building block but providing a number of advantages, notably stability and strength of structure. The positive linkage between neighbouring blocks is a marked advantage but also the ease with which alignment of seams in the finished structure can be avoided. Thus by providing half-length and half-depth blocks and a structure of the corner piece in which the inner walls and outer walls 28 are of different lengths a three dimensional running bond can be provided. This arrangement, as shown in FIGS. 6 and 7, is such that not only are vertical seams in a running bond but horizontal seams on the inside and outside of the structure are not aligned.

I claim:

1. A building unit combination comprising:

a building block interlocked with a building block end unit, the building block being able to interlock with a further, similar building block, the building block end unit of the combination comprising:

a wall portion having a flat outer surface, an inner surface and a predetermined width;

a flat end surface;

a first hollow projection extending from the inner surface of the wall portion, the projection comprising a narrow portion adjacent the inner surface and a wider portion extending from the narrow portion;

a second hollow projection extending from the inner wall and defined at one side by the flat end surface of the end unit, and at the other side by a wall remote from the end wall and comprising a first web extending outwardly from the inner surface of the wall portion and a second web, attached to the first web, and spaced further from the end surface than the first web;

a recess formed on the second projection, remote from the outer surface of the wall portion and the flat end surface and comprising a first surface, generally parallel to the inner surface of the wall portion and an end surface, generally parallel to the end wall;

a space defined between said first and second projections;

the building block comprising a wall portion having a flat outer surface, an inner surface and a predetermined width equal to the predetermined width of the wall portion of the end unit;

at least one hollow projection extending from the inner surface of the wall portion, corresponding to the first projection on the end unit, and comprising a narrow portion adjacent the inner surface of the wall portion and a wider portion extending from the narrow portion, said at least one hollow projection engaging the space defined between the first and second projections of the end unit to interlock said building block and said end unit, the width of the wide portion being substantially equal to the distance between the narrow portion of the first projection of the end unit and the first web of the second projection and the width of the narrow portion being substantially equal to the distance between the wide portion of the first projection and the second web of the second projection;

the wall portion having an extension at each end extending beyond the said at least one hollow projection of the building block by an amount substantially equal to half the width of a wider portion; and the recess of the corner unit receiving one said wall portion extension of the building block.

2. A combination as claimed in claim 1 in which the building block has two of said hollow projections extending from the inner surface of the wall portion; a space defined between said two projections.

3. A combination as claimed in claim 1 in which all projections are open at their tops and bottoms.

4. A combination as claimed in claim 1 in which the wall portion has an extension at each end, each extension extending beyond an end of the block by an amount substantially equal to half the width of a wider portion.

5. A combination as claimed in claim 1 interlocked with a plurality of additional building blocks, each building block being interlocked to neighbouring blocks by engagement of a hollow projection in the space defined between neighbouring hollow projections.

6. A combination as claimed in claim 5, further including a key to facilitate alignment of the blocks, the keys comprising:

a flat bar;

a second bar at right angles to the flat bar;

a plurality of projections extending from the first bar and matching in their peripheral shape the shape of a projection.

7. A combination as claimed in claim 5 further including a starting channel to receive a first course of blocks and comprising opposed parallel bars joined by an intersecting central web and having a general configuration of an I;

openings formed in the central web corresponding in shape to the interior of the hollow projections.

8. A combination as claimed in claim 5 further including a corner unit being of generally L-shape, the limbs of the L being of different length, with each limb of the L terminating in a shape corresponding to the shape of the end of the building block.

9. A combination as claimed in claim 5 further including a corner unit comprising:

a generally L-shaped unit having two flat inner and two flat outer walls;

the end of each limb of the L terminating in a projecting portion, one projecting portion on the outer face of one limb, the other projecting portion on the inner face of the other limb, a web extending from adjacent each projecting portion, the web extending away from the wall with the projecting portion with an extension to the web remote from the projection and extending in the same general direction of the projection, a recess on the surface remote from the projection whereby the ends of each corner unit may engage with a building block of a building unit combination as defined in claim 5.

10. A corner unit as claimed in claim 9 in which the two outer walls are of different length, one wall being longer than the other by an amount equal to half the length of a building block.

11. A combination as claimed in claim 5, further including a capping channel comprising opposed parallel surfaces;

a web extending between the surfaces;

openings in the web corresponding to the projections in a building block;

at least one side wall extending upwardly at an outer surface to receive the roof of the last course of blocks.

12. A combination as claimed in claim 11 which the outer wall ends in a channel section at its upper edge.

* * * * *